US008763588B2

(12) United States Patent
Sugiyama et al.

(10) Patent No.: US 8,763,588 B2
(45) Date of Patent: Jul. 1, 2014

(54) VIBRATION INSULATOR FOR FUEL INJECTION VALVE, AND SUPPORT STRUCTURE FOR FUEL INJECTION VALVE

(75) Inventors: Natsuki Sugiyama, Toyota (JP); Tomokazu Sumida, Akaiwa (JP); Seizo Watanabe, Akaiwa (JP)

(73) Assignees: Toyota Jidosha Kabushiki Kaisha, Toyota (JP); Uchiyama Manufacturing Corp., Okayama-shi (JP)

( * ) Notice: Subject to any disclaimer, the term of this patent is extended or adjusted under 35 U.S.C. 154(b) by 0 days.

(21) Appl. No.: 13/635,812

(22) PCT Filed: Mar. 30, 2010

(86) PCT No.: PCT/JP2010/055702

§ 371 (c)(1),
(2), (4) Date: Sep. 18, 2012

(87) PCT Pub. No.: WO2011/121728

PCT Pub. Date: Oct. 6, 2011

(65) Prior Publication Data

US 2013/0014719 A1 Jan. 17, 2013

(51) Int. Cl.
*F01L 3/20* (2006.01)

(52) U.S. Cl.
USPC ..... 123/470; 239/533.11; 277/591

(58) Field of Classification Search
USPC ..... 123/470; 277/591, 593, 594, 598; 239/533.11, 533.13, 600
See application file for complete search history.

(56) References Cited

U.S. PATENT DOCUMENTS

| | | | | | |
|---|---|---|---|---|---|
| 3,841,277 | A | * | 10/1974 | Schafer | 123/470 |
| 4,362,139 | A | * | 12/1982 | Isobe et al. | 123/364 |
| 4,647,012 | A | * | 3/1987 | Gartner | 251/148 |
| 5,954,343 | A | * | 9/1999 | Sumida et al. | 277/434 |
| 6,112,722 | A | * | 9/2000 | Barnhart et al. | 123/470 |

(Continued)

FOREIGN PATENT DOCUMENTS

| | | |
|---|---|---|
| JP | A-08-246994 | 9/1996 |
| JP | A-09-195891 | 7/1997 |

(Continued)

OTHER PUBLICATIONS

International Search Report issued in Application No. PCT/JP2010/062959; Dated Oct. 19, 2010 (With Translation).

(Continued)

*Primary Examiner* — Noah Kamen
*Assistant Examiner* — Grant Moubry
(74) *Attorney, Agent, or Firm* — Oliff PLC

(57) ABSTRACT

A vibration insulator which can compensate for axial eccentricity occurring in a fuel injection valve and suppress vibrations of the valve during operation of a combustion engine and a support structure for the valve. The vibration insulator is interposed between a step height portion of the valve and a shoulder portion. The step height portion is increased in diameter in a tapered fashion and inserted into an insertion hole of a cylinder head. The shoulder portion is annularly extended in an inlet portion of the insertion hole opposed to the step height portion. The vibration insulator includes an annular tolerance ring on an inner circumferential inclined face thereof with recessed tapered faces opposed to the tapered face of the step height portion and which abuts the tapered face. The taper angles of the tolerance ring and of the step height portion are set so as to be different.

14 Claims, 5 Drawing Sheets

(56) References Cited

U.S. PATENT DOCUMENTS

| | | | | |
|---|---|---|---|---|
| 6,263,863 | B1 * | 7/2001 | Giovannini et al. | 123/470 |
| 6,718,949 | B2 | 4/2004 | Gmelin | |
| 6,848,425 | B2 * | 2/2005 | Raimann | 123/470 |
| 6,866,026 | B2 * | 3/2005 | Mickelson | 123/470 |
| 6,899,087 | B2 * | 5/2005 | Norgauer | 123/470 |
| 7,373,925 | B2 * | 5/2008 | Reiter et al. | 123/470 |
| 7,559,312 | B2 * | 7/2009 | Brauneis et al. | 123/470 |
| 7,600,502 | B2 * | 10/2009 | Welzmueller et al. | 123/470 |
| 7,827,964 | B2 * | 11/2010 | Chern et al. | 123/470 |
| 7,832,376 | B2 * | 11/2010 | Mueller et al. | 123/470 |
| 2004/0020470 | A1 * | 2/2004 | Norgauer | 123/470 |
| 2004/0060544 | A1 * | 4/2004 | Reiter et al. | 123/470 |
| 2008/0302336 | A1 * | 12/2008 | Fuerst et al. | 123/470 |
| 2009/0071445 | A1 | 3/2009 | Mueller et al. | |
| 2009/0235898 | A1 * | 9/2009 | Short | 123/470 |

FOREIGN PATENT DOCUMENTS

| | | | |
|---|---|---|---|
| JP | A-11-210885 | | 8/1999 |
| JP | A-2001-324021 | | 11/2001 |
| JP | A-2004-506136 | | 2/2004 |
| JP | A-2004-204991 | | 7/2004 |
| JP | A-2007-247893 | | 9/2007 |
| JP | A-2008-516133 | | 5/2008 |
| JP | A-2008-128343 | | 6/2008 |
| JP | A-2008-256193 | | 10/2008 |
| JP | B2-4191734 | | 12/2008 |
| JP | A-2010-106758 | | 5/2010 |
| JP | A-2010-106759 | | 5/2010 |
| JP | A-2010-159726 | | 7/2010 |
| WO | WO 02/12718 | A1 | 2/2002 |
| WO | WO 2005/021956 | A1 | 3/2005 |
| WO | WO 2006/040227 | A1 | 4/2006 |
| WO | WO 2012/014326 | A1 | 2/2012 |

OTHER PUBLICATIONS

International Search Report issued in Application No. PCT/JP2010/055702; Dated Jul. 6, 2010 (With Translation).

* cited by examiner

VIBRATION INSULATOR FOR FUEL INJECTION VALVE, AND SUPPORT STRUCTURE FOR FUEL INJECTION VALVE

FIELD OF THE DISCLOSURE

The present invention relates to a vibration insulator for a fuel injection valve that is configured to damp vibration that occurs in the fuel injection valve, which injects fuel into an internal combustion engine, and to a support structure for a fuel injection valve using the vibration insulator.

BACKGROUND OF THE DISCLOSURE

Conventionally, internal combustion engines of one type in which fuel is injected into the inside of a combustion chamber, that is, internal combustion engines of the in-cylinder injection type, for example, have the distal end portion of a fuel injection valve inserted into and supported by an insertion hole of a cylinder head and have the proximal end portion of the fuel injection valve inserted into and supported by a delivery pipe (a fuel injection valve cup), whereby the fuel injection valve is provided across the cylinder head and the delivery pipe. Usually, when the fuel pressure supplied through the delivery pipe changes due to injection or stopping of the fuel, vibration based on the change in fuel pressure occurs to the above fuel injection valve. For this reason, it is often the case that a vibration insulator to absorb and damp such vibration of a fuel injection valve is attached between the fuel injection valve and an insertion hole of a cylinder head.

On the other hand, the cylinder head and the delivery pipe are originally parts of separate bodies. Therefore, changes in the relative positions thereof, which are caused by, for example, tolerances associated with production or processing of these parts, tolerances associated with assembly in the production, thermal deformation, and various vibrations that accompany the operation of the internal combustion engine, are unavoidable. That is, the axis of the fuel injection valve provided across the cylinder head and the delivery pipe becomes inclined relative to the axis of the insertion hole of the cylinder head, whereby positions at which the fuel injection valve is supported by the cylinder head and the delivery pipe deviate from correct positions. Further, such positional deviation causes problems such as partial slack of an O-ring at the proximal end of the fuel injection valve, the O-ring serving to prevent fuel leakage between the fuel injection valve and the delivery pipe (fuel injection valve cup). Therefore, the positional deviation may possibly cause fuel leakage.

For this reason, insulators designed to not only absorb and damp vibration of the fuel injection valve but also reduce the influence of such inclination of the axis of the fuel injection valve have been proposed, and an insulator described in Patent Document 1 is known as one example thereof. The insulator described in Patent Document 1 includes an annular adjustment element sandwiched between a shoulder section having an opening into a side wall of an insertion hole (a receiving hole) of the cylinder head and a stepped section of a fuel injection valve arranged by being inserted into the insertion hole, the diameter of which is enlarged in a tapered manner to face the shoulder section. The adjustment element has a first leg extending along the shoulder section of the insertion hole and a second leg extending along the tapered stepped section of the fuel injection valve. A structure elastically supporting the fuel injection valve with respect to the cylinder head is obtained by having the first leg in surface contact with the shoulder section of the insertion hole and having the second leg in surface contact with the tapered stepped section of the fuel injection valve.

PRIOR ART DOCUMENT

Patent Document

Patent Document 1: Japanese Patent No. 4191734

SUMMARY OF THE INVENTION

Problems that the Invention is to Solve

According to the thus configured insulator, even when the axis of the fuel injection valve has deviated from the centered position between the insertion hole of the cylinder head and a delivery pipe in assembly, the first leg moves along the shoulder section of the insertion hole due to a force generated by the second leg, which flexes in accordance with the tapered stepped section of the fuel injection valve. This serves to appropriately compensate for the positional relations of the fuel injection valve with the insertion hole and the delivery pipe. On the other hand, when the internal combustion engine is operated, a high pressing force based on the above described fuel pressure presses the first leg and the second leg of the adjustment element against the shoulder section of the insertion hole and the tapered stepped section of the fuel injection valve, respectively, resulting in an increase of the frictional force between the shoulder section or the stepped section and the individual legs and a reduction of the position adjustment performance based on the movement of each leg as an adjustment element. That is, when the axis of the fuel injection valve is deviated from the centered position while the mobility of each leg has been reduced, a force that prevents such deviation may act. Specifically, the reactive force from each deformed leg in accordance with the pressing force applied to the adjustment element may press against the fuel injection valve. When such a force acts on the fuel injection valve, the above-described reduction of the sealing performance between the fuel injection valve and the delivery pipe by the O-ring may occur.

The present invention has been accomplished in view of the above circumstances, and it is an objective of the present invention to provide a vibration insulator for fuel injection that is capable of, even when an internal combustion engine is in operation, maintaining not only the function of damping vibration of the fuel injection valve but also the function of automatically compensating for deviation of the axis of the fuel injection valve from the centered position and to provide a support structure for a fuel injection valve using the vibration insulator.

Means for Solving the Problems

Means for solving the above objectives and advantages thereof will now be discussed.

To achieve the foregoing objective and in accordance with the present invention, a vibration insulator for a fuel injection valve is provided. The vibration insulator damps vibration that occurs to the fuel injection valve. The fuel injection valve is mounted on a cylinder head while being inserted into an insertion hole provided in the cylinder head, a shoulder section is annularly formed at an inlet portion of the insertion hole in a widening manner. The fuel injection valve includes a stepped section, the diameter of which is enlarged in a tapered manner so that the stepped section has a first tapered surface facing the shoulder section. The vibration insulator is located between the stepped section and the shoulder section. The vibration insulator includes a circular ring-like tolerance ring abutting the first tapered surface by having, on the inner circumference thereof, a recessed second tapered surface facing the first tapered surface. A tapering angle of the second tapered surface is different from a tapering angle of the first tapered surface.

Accordingly, the tapering angle of the tapered surface (first tapered surface) of the stepped section, the diameter of which is enlarged in a tapered manner of the fuel injection valve is made different from the tapering angle of the tapered surface (second tapered surface) of the tolerance ring inner circumference, so that the tapered surface of the stepped section makes line-contact with the tapered surface of the tolerance ring inner circumference, precisely, the circumferential edge of the tapered surface of the tolerance ring inner circumference. That is, even if a force that deviates the axis of the fuel injection valve from the centered position is produced with respect to the insertion hole of the cylinder head, there is compensation for such a deviation (slope) of the fuel injection valve through tracing of the tapered surface of the stepped section of the fuel injection valve by the above tolerance ring, which provides line-contact support. In the above-described fuel injection valve provided across the cylinder head and the delivery pipe in a manner that the distal end portion is inserted into the insertion hole of the cylinder head and the proximal end portion is supported by the delivery pipe via a sealing member such as an O-ring, even if a force that deviates the axis of fuel injection valve from the centered position due to application of fuel pressure associated with operation of the internal combustion engine is produced, the above tolerance ring compensates for such deviation and supports the fuel injection valve through line-contact. Therefore, the sealing performance at the proximal end portion of the injection valve supported by the delivery pipe via the above sealing member is well maintained.

The second tapered surface may be formed into two steps such that a ridgeline exists as a border between the steps, and that the ridgeline abuts the first tapered surface, the ridgeline projecting toward an inner circumference of the tolerance ring.

According to this configuration, when the axis of the fuel injection valve is deviated from the centered position, the fuel injection valve slides on the ridgeline of the tolerance ring, whereby the deviation of the axis is automatically compensated for.

By reducing the difference in the angle between the two-stepped tapered surfaces, the ridgeline can suitably receive the pressing force even if the ridgeline is pressed against the tapered surface of the fuel injection valve with a strong force. Thus, the reliability and stability of the vibration insulator is increased.

The tapering angle of the first tapered surface and the tapering angle of the second tapered surface may be set such that an upper circumferential edge of the second tapered surface abuts the first tapered surface.

According to this configuration, even if the tapered surface of the inner circumference of the tolerance ring is configured to be one-stepped, the upper circumferential edge thereof abuts the tapered surface of the fuel injection valve, whereby deviation of the fuel injection valve can be compensated for. In addition, providing the inner circumference of the tolerance ring with one-stepped tapered surface improves the feasibility.

The tolerance ring may be formed of metal having the same level of hardness as a housing of the fuel injection valve.

According to this configuration, even if the fuel injection valve and the tolerance ring are strongly pressed against each other, one of the fuel injection valve and the tolerance ring, which are abutted against each other, does not deform the other, but they evenly contact each other, whereby the reliability and the stability of the vibration insulator are improved.

The vibration insulator may include an elastic member arranged between the tolerance ring and the shoulder section. In order to perform damping of vibration that occurs to the fuel injection valve, the elastic member may be formed in a circular ring-like shape corresponding to the bottom surface of the tolerance ring. A coil spring, which is arranged in a circular ring-like shape in a manner corresponding to the circular ring-like shape of the elastic member, and a sleeve, which is provided side by side with the coil spring, may be embedded in the elastic member, and the height of the sleeve may be lower than the outer diameter of each of small spring sections composing the helix of the coil spring, and the stiffness of the sleeve may be higher than the stiffness of the coil spring.

This configuration restricts excessive deformation of the elastic member, which might plastically deform when deformed greatly by receiving a strong pressing force from the fuel injection valve, and allows the elastic member to be used within a range (with a height) that permits the elastic member to elastically deform. As a result, the elasticity of the elastic member is suitably maintained, and the function of absorbing and damping vibration by means of the elasticity thereof is maintained.

The coil spring and the sleeve may be embedded in the elastic member while being maintained in a state not contacting with each other.

This configuration reduces interference of the sleeve with the coil spring. Therefore, the risk of changing the vibration damping performance imparted to the coil spring by interference of the sleeve is reduced. As a result, the vibration damping characteristics of the vibration insulator can be appropriately maintained.

The sleeve may be located toward the outer circumference of the coil spring.

This configuration enables size reduction of coil spring. Also, when the sleeve is located on the outside, the size of the sleeve does not become such a size that allows the sleeve to fall in the insertion hole of the cylinder head.

The sleeve may be located toward the inner circumference of the coil spring.

This configuration makes the size of the coil spring large and also enables the pressure resistance to the pressing force to increase.

The elastic member may be formed of a rubber-based material, and the coil spring and the sleeve may be formed of metal materials.

This configuration enables characteristics suitable for absorbing and damping vibration of the fuel injection valve to be imparted.

The vibration insulator may further include a circular ring-like metal plate located between the elastic member and the shoulder section. The metal plate may be configured to pinch the tolerance ring and the elastic member together from the inner circumference of the tolerance ring.

According this configuration, the relative position of the tolerance ring, which is not easy to be strongly joined to the elastic member, with respect to the elastic member is defined by the plate from the inner circumferential surface. Therefore, appropriate stacking of the tolerance ring on the elastic member is facilitated, whereby the feasibility of the vibration insulator as described herein is improved.

The metal plate may be formed by pressing such that a burr is generated at an outer circumferential edge of the metal plate, the burr having been cut upward toward the elastic member.

Normally, the size of the shoulder section formed on the insertion hole of the cylinder head is formed into the requisite minimum size that enables deviation of the axis of the fuel injection valve from the centered position to be compensated for by movement of the vibration insulator.

According to the above-described configuration, however, the vibration insulator is prevented from overriding a bulge left at the outer circumferential part of the shoulder section of the cylinder head. Furthermore, the size of the shoulder section formed on the insertion hole can be formed into the requisite minimum size. As a result, even if the vibration insulator is moved toward the outside of the shoulder section, the height accuracy and compensation accuracy can be maintained without reduction of its mobility or change of the height with respect to the tapered surface the fuel injection valve by overriding a bulge.

The metal plate may be formed of a metal having a lower level of hardness than the tolerance ring.

This configuration allows a material suitable for pressing to be selected for the plate, enabling an appropriate processing of the plate and making the vibration insulator having such a structure more feasible.

In addition, for the plate, a member that enables the plate to slide on the shoulder section and is suitable for widely dispersing and transmitting the pressure received from the elastic member to the shoulder section can be selected. As a result, the durability and performance of the vibration insulator can be maintained and improved, resulting in further increase in reliability.

In accordance with the present invention, a fuel injection valve supporting structure for supporting a fuel injection valve by using a vibration insulator is provided. The fuel injection valve is mounted on a cylinder head while being inserted into an insertion hole provided in the cylinder head. A shoulder section is annularly formed at an inlet portion of the insertion hole in a widening manner. The fuel injection valve includes a stepped section, the diameter of which is enlarged in a tapered manner so that the step section has a first tapered surface facing the shoulder section. The vibration insulator is configured to damp vibration occurred to the fuel injection valve by interposing the vibration insulator between the stepped section and the shoulder section. The vibration insulator includes a circular ring-like tolerance ring abutting the first tapered surface by having, on the inner circumference thereof, a recessed second tapered surface facing the first tapered surface. A tapering angle of the second tapered surface is different from a tapering angle of the first tapered surface.

In this way, the tapering angle of the tapered surface (first tapered surface) of the stepped section of the fuel injection valve, the diameter of which is enlarged in a tapered manner, and the tapering angle of the tapered surface (second tapered surface) of the tolerance ring inner circumference are made different, whereby precisely one of the tapered surface of the stepped section and the tapered surface of the tolerance ring inner circumference is brought into line-contact with the circumferential edge of the other's tapered surface. That is, even if a force that deviates the axis of the fuel injection valve from the centered position is produced with respect to the insertion hole of the cylinder head, such a deviation (slope) of the fuel injection valve from the centered position is compensated for through tracing by the tapered surface of the stepped section of the fuel injection valve with respect to the above tolerance ring which supports by line-contact. In the above-described fuel injection valve provided across the cylinder head and the delivery pipe in a manner that the distal end portion is inserted into the insertion hole of the cylinder head and the proximal end portion is supported by the delivery pipe via a sealing member such as O-ring, even if a force that deviates the axis of fuel injection valve from the centered position due to application of fuel pressure associated with operation of the internal combustion engine is applied, such a deviation is compensated for by the above tolerance ring, which supports the fuel injection valve by line-contact. Therefore, the sealing performance at the proximal end portion of the injection valve supported by the delivery pipe via the above sealing member is well maintained.

The first tapered surface may be formed into two steps such that a ridgeline exists as a border between the steps, and the ridgeline may abut the second tapered surface, the ridgeline projecting toward the outer circumference.

According to this configuration, the tapered surface of the inner circumference of the tolerance ring abuts the ridgeline of the fuel injection valve. When the axis of the fuel injection valve is deviated from the centered position, the ridgeline slides on the tapered surface of the inner circumference of the tolerance ring, automatically compensating for the deviation of the axis from the centered position.

Also, reduction of the difference of angles of the two-stepped tapered surfaces enables the ridgeline to suitably receive the pressing force even if it is pressed against the tapered surface of the inner circumference of the tolerance ring by a strong force. As a result, reliability and stability of the support structure of the fuel injection valve are improved.

DETAILED DESCRIPTION OF THE PREFERRED EMBODIMENTS

First Embodiment

A vibration insulator according to a first embodiment of the present invention will be described with reference to the drawings.

Figure 2:
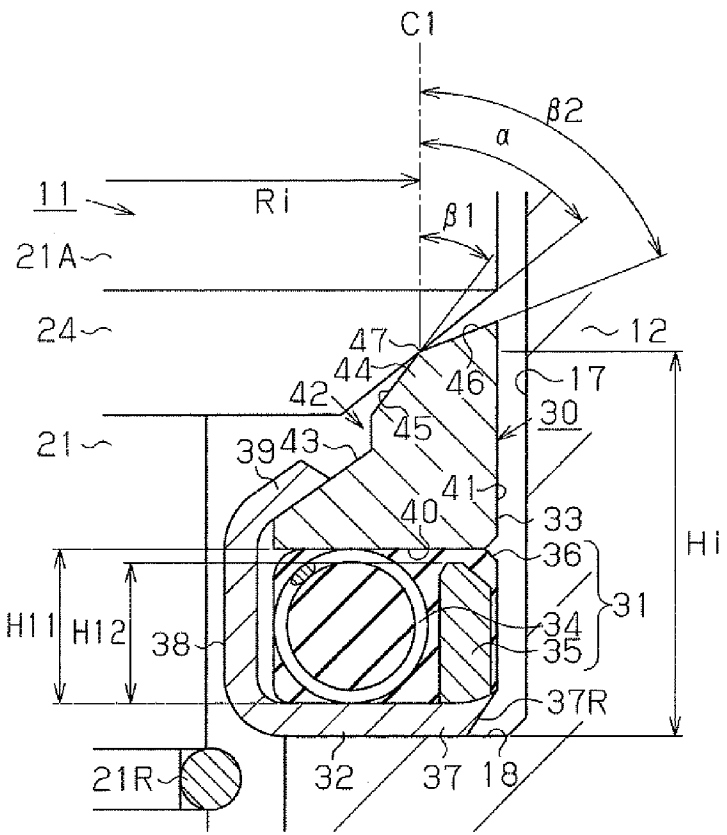
FIG. 2 is an end view showing the structure of an end face of the vibration insulator of the first embodiment.
Figure 1:
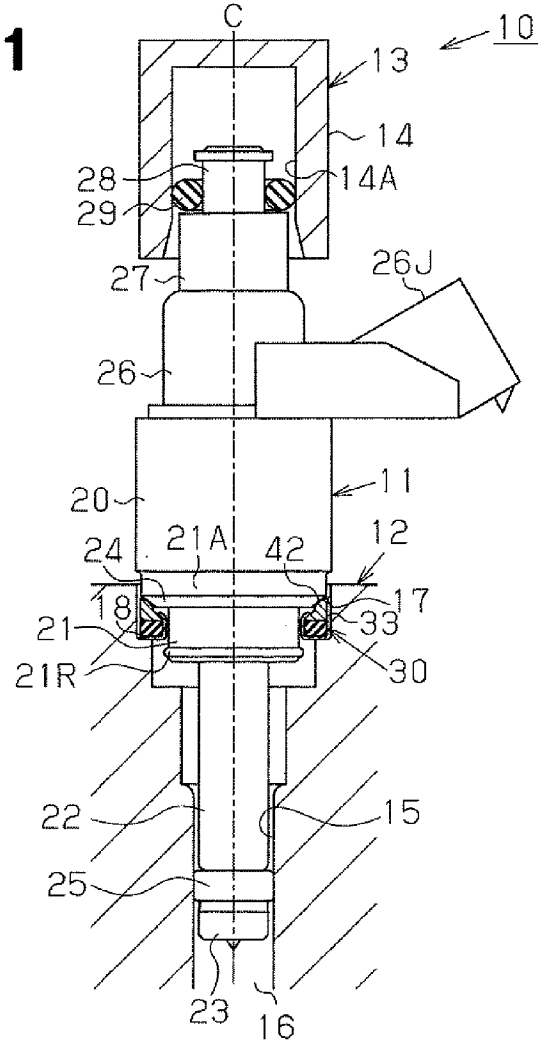
FIG. 1 is a diagram schematically showing the outline of a fuel injection system to which a first embodiment of a vibration insulator according to the present invention is applied.
Figure 3A:
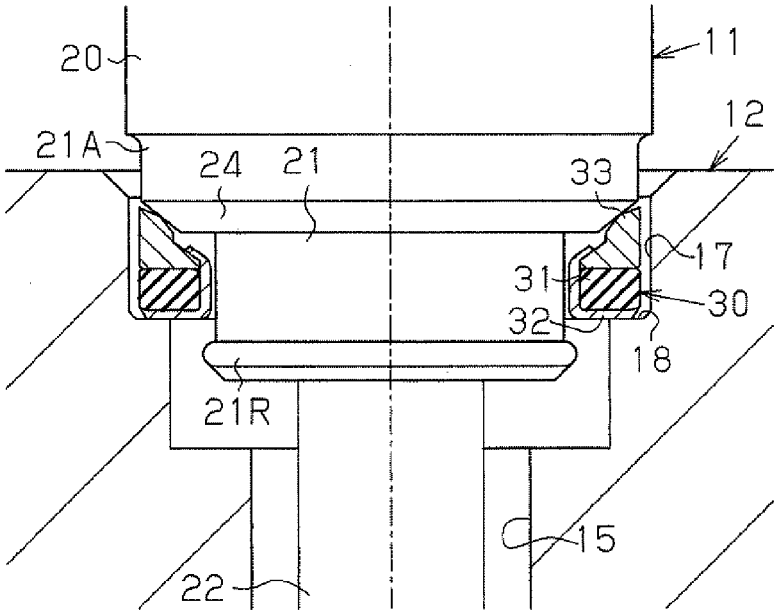
FIGS. 3(*a*) and 3(*b*) are diagrams illustrating a compensating function of the vibration insulator of the first embodiment, where FIG. 5(*a*) shows a centered state, and FIG. 5(*b*) shows an off-center state.
Figure 3B:
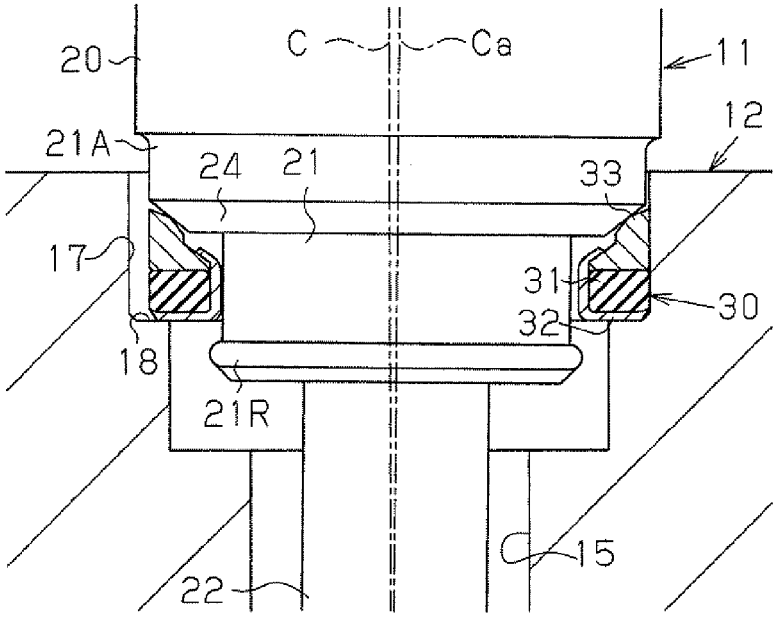

FIG. 1 is a diagram schematically showing the structure of a fuel injection system 10 to which a vibration insulator 30 according to this embodiment is applied. FIG. 2 is a diagram showing the structure of an end face of the vibration insulator 30 in an end view. FIGS. 3(*a*) and 3(*b*) are diagrams for illustrating the states of compensating for movement of the vibration insulator 30. FIG. 3(*a*) shows the fuel injection valve 11 in the state where the axis C thereof is not inclined.

As shown in FIG. 1, the fuel injection system 10 is provided with a fuel injection valve 11. A part of the fuel injection valve 11 in the distal end portion is supported by the insertion hole 15 of the cylinder head 12, and another part of the fuel injection valve 11 in the proximal end portion is supported by the fuel injection valve cup 14 of the delivery pipe 13. Thus, the fuel injection valve 11 is provided across the cylinder head 12 and the delivery pipe 13.

The insertion hole 15 of the cylinder head 12 is formed, as a hole stepped with multiple steps, to extend through the cylinder head 12 from an outer surface thereof to an inner surface thereof, the hole having a hole diameter that narrows sequentially in a direction from the outer surface of the cylinder head 12 (the upper surface of FIG. 1) toward the inner surface (the lower surface of FIG. 1). That is, the hole diameter at an inlet section 17, which is an entrance from the outer surface of the cylinder head 12, is the largest, and the hole diameter at a distal end hole section 16, which opens through the inner surface, is the smallest. As a result, a stepped section based on a difference in the hole diameter is formed on each part of the insertion hole 15 at which the hole diameter changes. The stepped section between the inlet section 17 and the hole diameter section under the inlet section 17 is referred to especially as the shoulder section 18. In other words, the shoulder section 18 is provided such that the opening of the inlet section 17 is annularly enlarged. The distal end hole section 16 of the insertion hole 15 is communicated with the combustion chamber of the in-cylinder injection type internal combustion engine, and an injection nozzle 23 of the fuel injection valve 11 is inserted into and thereby mounted on the insertion hole 15. That is, the distal end hole section 16 is configured to introduce high pressure fuel injected from the injection nozzle 23 into the combustion chamber.

The delivery pipe 13 is designed to supply, to the fuel injection valve 11, high pressure fuel, the pressure of which has been accumulated to an injection pressure in the delivery pipe 13 and has the fuel injection valve cup 14 that the proximal end portion of the fuel injection valve 11 is inserted into and thereby mounted on. The fuel sealing performance between the fuel injection valve 11 and the inner circumferential surface 14A of the fuel injection valve cup 14 is ensured by an O-ring 29 arranged therebetween.

The fuel injection valve 11 is designed to inject high pressure fuel, which is supplied from the delivery pipe 13, into the combustion chamber communicating with the cylinder head 12 with predetermined timing. The housing of the fuel injection valve 11 has a cylindrical shape, stepped with multiple steps, which narrows sequentially in directions from the center toward the distal end and toward the proximal end.

That is, the housing of the fuel injection valve 11 includes a large diameter section 20 at the center thereof, and includes in order from the large diameter section 20 toward the proximal end: a proximal relay section 26 having a smaller diameter than the large diameter section 20; a proximal insertion section 27 having a smaller diameter than the proximal relay section 26; and a proximal sealing section 28 having a smaller diameter than the proximal insertion section 27. The proximal relay section 26 is provided with a connector 26J to which wiring for transmission of a drive signal to, for example, an electromagnetic valve built inside the fuel injection valve 11. The O-ring 29 is inserted in the proximal sealing section 28.

The O-ring 29 is formed of an elastic member made of rubber or the like that is fuel-resistant, substantially in a circular ring-like shape and has pressure resistance against the pressure of high pressure fuel. The inner circumference of the O-ring 29 is configured to contact tightly to the outer circumferential surface of the proximal sealing section 28, and therefore delivers, through tight contact between the inner circumference of the O-ring 29 and the outer circumferential surface of the proximal sealing section 28, sealing performance that prevents fuel leakage of high pressure fuel between the fuel injection valve 11 and the O-ring 29. Furthermore, the outer circumference of the O-ring 29 is formed into a size that allows the O-ring 29 to tightly contact the inner circumferential surface 14A of the fuel injection valve cup 14 of the delivery pipe 13. As a result, when the proximal end of the fuel injection valve 11 is inserted into the fuel injection valve cup 14 of the delivery pipe 13, the outer circumference of the O-ring 29 of the fuel injection valve 11 tightly contacts the inner circumferential surface 14A of the fuel injection valve cup 14, and thereby displays a sealing performance against the high pressure fuel. When the O-ring 29 displays the sealing performance toward both of the outer circumferential surface of the proximal sealing section 28 and the inner circumferential surface 14A of the fuel injection valve cup 14, the fuel sealing performance against the high pressure fuel is ensured between the fuel injection valve 11 and the fuel injection valve cup 14.

The sealing performance against high pressure fuel ensured between the fuel injection valve 11 and the delivery pipe 13 via the O-ring 29 is maintained at high levels when the distance between the outer circumferential surface of the proximal sealing section 28 and the inner circumferential surface 14A of the fuel injection valve cup 14 is made uniform over the entire perimeter, for example, when the axis C of the fuel injection valve 11 aligns with the axis of the fuel injection valve cup 14. That is, the O-ring 29 is located with a uniform thickness all around the perimeter between the outer circumferential surface of the proximal sealing section 28 and the inner circumferential surface 14A, whereby a uniform sealing performance is ensured on the whole perimeter. On the other hand, if the distance between the outer circumferential surface of the proximal sealing section 28 and the inner circumferential surface 14A is not made uniform on the whole perimeter, the thickness of the O-ring 29 is not made uniform on the whole perimeter. That is, the O-ring 29 produces a large reactive force at a portion that has been strongly pressed and thinned, and delivers a high adhesion force between the O-ring and the inner circumferential surface 14A of the fuel injection valve cup 14. In contrast, the O-ring produces a reduced reactive force at a portion to which a small pressing force is applied and the adhesion between the O-ring and the inner circumferential surface 14A is reduced. Thus, when the axis C of the fuel injection valve 11 and the axis of the fuel injection valve cup 14 deviate from the centered position especially in the vicinity of the center of the O-ring 29, the sealing performance between the fuel injection valve 11 and the fuel injection valve cup 14 is reduced, possibly causing leakage of high pressure fuel.

Furthermore, the housing of the fuel injection valve 11 includes in order from the large diameter section 20 toward the distal end: a medium diameter section 21 having a narrower diameter than the large diameter section 20; and a small diameter section 22 having a narrower diameter than the medium diameter section 21. The injection nozzle 23, which injects fuel, is provided at the distal end of the small diameter section 22. A sealed section 25 used for ensuring a sealing performance thereof with the wall surface of the insertion hole 15 to maintain airtightness of the combustion chamber, which is connected to the insertion hole 15, is provided in a part of the small diameter section 22 located nearer to the proximal end than injection nozzle 23 is located.

Between the large diameter section 20 and the medium diameter section 21, a stepped section based on the difference between the outer diameter of the large diameter section 20 and the outer diameter of the medium diameter section 21 is formed, and this stepped section is provided with a tapered surface 24 having a shape narrowed in a direction toward the distal end. That is, when the fuel injection valve 11 is inserted into the insertion hole 15, the tapered surface 24 of the fuel injection valve 11 faces the shoulder section 18 located at the inlet section 17 of the insertion hole 15 of the cylinder head 12 with a predetermined slope. The angle $\alpha$ of the tapered surface 24 with respect to the central axis (axis C) of the fuel injection valve 11 is shown as an angle with respect to an axis parallel C1, which is parallel to the axis C. Specifically, although it is preferable for the angle $\alpha$ of this tapered surface 24 to be 30 to 60 degrees, the angle $\alpha$ is selectable from values larger than 0 degrees and smaller than 90 degrees.

An annular vibration insulator 30 is provided between the tapered surface 24 of the fuel injection valve 11 and the shoulder section 18 of the insertion hole 15. The vibration insulator 30 is designed for absorbing and damping, when a change in the fuel pressure of fuel supplied through the delivery pipe 13 has occurred with the fuel having been injected or stopped by the fuel injection valve 11, vibration that occurs to the fuel injection valve 11 based on the fuel pressure change.

The outer diameter of the vibration insulator 30 is formed with a size that enables the vibration insulator to be placed on the annular shoulder section 18, and the inner diameter of the vibration insulator 30 is formed with a size that permits the medium diameter section 21 of the fuel injection valve 11 to be inserted through the vibration insulator 30 with play existing between the medium diameter section 21 and the vibration insulator 30. Also, the medium diameter section 21 is provided with a ring 21R having an outer diameter that is larger than the inner diameter of the vibration insulator 30 in the distal end of the fuel injection valve 11. As shown in FIG. 1, the vibration insulator 30, under the condition where the medium diameter section 21 is inserted therethrough, is prevented by the ring 21R from coming off from the medium diameter section 21 of the fuel injection valve 11.

As shown in FIG. 2, the vibration insulator 30 includes an annular vibration damping member 31; an annular plate 32 formed with a cross section having a channel-like shape substantially surrounding the lower part (the lower side in FIG. 2) and the inner circumferential section (the left side in FIG. 2) of the vibration damping member 31; and an annular tolerance ring 33 provided in the upper part of vibration damping member 31 (the upper part in FIG. 2). That is, the vibration damping member 31 is stacked on the plate bottom section 37 of the plate 32 and the tolerance ring 33 is further stacked on the vibration damping member 31.

The vibration damping member 31 is a member that absorbs and damps vibration of the fuel injection valve 11 and includes an elastic member 36 made of rubber or the like; a coil spring 34 annularly embedded in the elastic member 36; and a sleeve 35 located toward the outer circumference from the coil spring 34 and also annularly embedded in the elastic member 36. That is, the coil spring 34 is formed in a shape obtained by curving a helical long body into a loop such that the helical long body surrounds the fuel injection valve 11, and one of the individual small ring sections, which form the helix by continually being connected, is shown in FIG. 2. The outer diameter H11 of the small ring section is also shown in FIG. 2.

The elastic member 36 is produced using, as a material, rubber or elastomer such as TPE, the rubber having been obtained by using fluorine rubber, nitrile rubber, hydrogenation nitrile rubber, fluorosilicone rubber, or acrylic rubber as a main ingredient and blending into the main ingredient a filler, such as carbon black, silica, clay, or calcium carbonate celite, and an antioxidant, a processing aid, and a vulcanizing agent that are suitable for each kind of rubber.

The coil spring 34 is produced using, as a material, spring steel as exemplified by stainless steel and piano wire.

The sleeve 35 has a higher stiffness than the coil spring 34 and is annularly formed of metal including iron and stainless steel or engineering plastic having a high stiffness, for example. The inner diameter of the sleeve 35 is sized not to contact the coil spring 34 located toward the inner circumference of the sleeve 35. The sleeve 35 is formed to have the height H12 lower than the outer circumference H11 of the small ring section of the coil spring 34 in cross section (H12<H11).

Thus, characteristics suitable for absorption and damping of vibration that occurs to the fuel injection valve 11 are imparted to the vibration damping member 31 based on vibration absorbing and vibration damping characteristics shown by the elastic member 36 and vibration absorbing and vibration damping characteristics shown by the coil spring 34.

Assuming that the sleeve 35 is not provided, the elastic member 36 and the coil spring 34 show appropriate vibration absorbing and vibration damping characteristics by appropriate elastic deformation when a load within a predetermined range that permits the maintenance of the elasticity thereof is applied thereto, but application of a load exceeding the predetermined range may cause plastic deformation and loss of the elasticity, failing to show appropriate vibration absorbing and vibration damping characteristics. In this embodiment, however, the sleeve 35 prevents an excessive deformation of the elastic member 36 and the coil spring 34 even if a load exceeding the predetermined range is applied thereto. That is, when the elastic member 36 and the coil spring 34 experience deformation in forms vertically crushed by a pressing force from the fuel injection valve 11, the elastic member 36 and the coil spring 34 deform freely as long as the amount of deformation thereof is a predetermined amount of deformation or smaller. When a load that causes deformation exceeding a predetermined amount of deformation is applied, the sleeve 35 prevents the elastic member 36 and the coil spring 34 from being deformed to a level exceeding the predetermined amount of deformation. Therefore, even if a high pressure is suddenly applied to the vibration damping member 31, the sleeve 35 prevents plastic deformation of the elastic member 36 and the coil spring 34, and the elasticity of the elastic member 36 and the coil spring 34 is maintained.

The sleeve 35 is configured not to contact the coil spring 34. This reduces the possibility that abutting of the coil spring 34 against the sleeve 35 causes change in the vibration absorbing and vibration damping characteristics of the coil spring 34. Therefore, the vibration damping member 31 can show suitable vibration absorbing and vibration damping characteristics on which the sleeve 35 has little effect.

The plate 32 is formed of a metal such as stainless steel, for example, SUS 430, which is a stainless steel material to which a drawing process is easily applicable. As shown in FIG. 2, the plate 32 is formed with a cross section having a channel-like shape, and includes: a plate bottom section 37; a plate inner wall section 38 extending upward from the inner circumference of the plate bottom section 37 and along the vibration damping member 31; a plate inner end section 39 folded toward the outer circumference from the upper end of the plate inner wall section 38 and covering an inner circumferential section of the tolerance ring 33.

The vibration damping member 31 is connected to the upper surface of the plate bottom section 37, and the lower surface of the plate bottom section 37 is caused to abut the shoulder section 18 of the insertion hole 15. As a result, not only suitable sideward sliding of the plate 32 with respect to the shoulder section 18 of the insertion hole 15 is maintained, but also the force received by the plate 32 from the coil spring 34 and the sleeve 35 is distributed evenly across the annular shoulder section 18. Since the shoulder section 18 is a part of the cylinder head 12 formed of aluminum or the like, the hardness of the shoulder section 18 is lower than that of the coil spring 34 and the sleeve 35. Therefore, it is expected that, when the coil spring 34 or the sleeve 35 comes in direct contact with the shoulder section 18, an inconvenience of having a part of the shoulder section 18, on which a force is concentrated, shaved or deformed may occur. However, in this embodiment, a force received by the plate 32 from the coil spring 34 and the sleeve 35 passes through the annular plate bottom section 37 which corresponds to the annular shoulder section 18, and is transmitted to the shoulder section 18 while being circumferentially dispersed. Therefore, the plate 32 prevents occurrence of the inconvenience that might occur when the coil spring 34 or the sleeve 35 comes in direct contact with the shoulder section 18.

As shown in FIG. 2, a burr section 37R obtained by being pressed is formed at the end section of the plate bottom section 37 in the outer circumference thereof. That is, the burr section 37R is cut diagonally upward from the bottom face of the plate bottom section 37 toward the outer circumference. The burr section 37R is provided so as to prevent the plate bottom section 37 from being caught by or overriding a portion that remains unshaved as a bulge at the outer circumferential end of the shoulder section 18 when the vibration insulator 30, with the plate bottom section 37 having been located in the vicinity of the center of the shoulder section 18 away from the outer circumferential surface of the inlet section 17 as shown in FIG. 3(*a*), slides on the shoulder section 18 and moves to the outer circumferential surface of the inlet section 17 as shown in FIG. 3(*b*). That is, the burr section 37R is formed in a shape that does not come in contact with any portion that remains unshaved as a bulge at the outer circumferential end of the shoulder section 18. A bulge at the outer circumferential end of the shoulder section 18 may be formed intentionally. In FIGS. 3(*a*) and 3(*b*), the coil spring 34 and the sleeve 35 are not shown in order to prevent complication of views.

The burr section 37R as described above also prevents the outer circumferential end of the plate bottom section 37 from interfering with any bulge portion at the outer circumferential end of the shoulder section 18, even when the vibration insulator 30 has moved until the vibration insulator 30 abuts the outer circumference of the shoulder section 18. In other words, the burr section 37R prevents decrease in mobility of the plate 32, which might be caused, for example, when the plate bottom section 37 is caught by a bulge portion at the outer circumferential end of the shoulder section 18. Besides, the burr section 37R prevents, for example, an incidence where a position (a position that is the height Hi upward apart from the shoulder section 18 in FIG. 2) at which the tolerance ring 33 abuts the tapered surface 24 of the fuel injection valve 11 considerably changes with the plate bottom section 37, which has overridden a bulge portion and become inclined.

As shown in FIG. 2, the plate inner wall section 38 is formed to rise along the vibration damping member 31 from the inner circumferential end of the plate bottom section 37, thereby being extended upward along the medium diameter section 21 of the fuel injection valve 11.

The plate inner end section 39 extends such that the distal end section of the plate inner wall section 38 covers a part of an inner circumferential sloping surface 42 of the tolerance ring 33 stacked on the vibration damping member 31. Further, the plate inner end section 39 is abutted by the inner circumferential sloping surface 42 of the tolerance ring 33, and imparts to the inner circumferential sloping surface 42 a force acting toward the outer circumference and downward. As a result, the plate inner end section 39 functions not only to reinforce connection between the tolerance ring 33 and the vibration damping member 31, but also to prevent the relative position between tolerance ring 33 and vibration damping member 31 from changing.

The tolerance ring 33 supports the fuel injection valve 11 with respect to the cylinder head 12 by abutting the tapered surface 24 of the fuel injection valve 11. The tolerance ring 33 is formed of metal such as stainless steel, for example, SUS 304, which is a hard stainless steel material. As shown in FIG. 2, the cross section of the tolerance ring 33 is shaped in a right-angled triangle, and the tolerance ring 33 includes; a ring bottom surface 40 connected to the vibration damping member 31; an outer circumferential surface 41 of the ring; and an inner circumferential sloping surface 42 extending from the upper part of the outer circumferential surface 41 of the ring to the inner circumferential end of the bottom surface 40 of the ring. That is, the inner circumferential sloping surface 42 forms, in the cross section of the tolerance ring 33, a tapering shape that defines a concave around the center of the tolerance ring 33. Although metal having the same hardness as the tapered surface 24 of the fuel injection valve 11 is adopted as metal used as a material for the tolerance ring 33, metal having the same hardness as a member, the coil spring 34 for example, having another level of hardness may be adopted.

The ring bottom surface 40 is laminated onto the upper surface of the vibration damping member 31, as shown in FIG. 2. The ring bottom surface 40 functions to transmit a pressing force to the upper surface of vibration damping member 31 through the entirety of the ring bottom surface 40, the pressing force having been received by the tolerance ring 33 from the fuel injection valve 11, whereby the pressing force is evenly applied to the vibration damping member 31. As a result, inconveniences are prevented from occurring which include an incident where a locally concentrated force causes the vibration damping member 31 to plastically deform.

The diameter of the outer circumferential surface 41 of the ring is formed to have a diameter substantially equal to the outer diameter of the vibration damping member 31. In other words, the diameter of the outer circumferential surface 41 of the ring is set not to narrow the moving range of the vibration insulator 30, in the inlet section 17 of the insertion hole 15.

As shown in FIG. 2, the inner circumferential sloping surface 42 is configured to have three slopes. In other words, the inner circumferential sloping surface 42 has: a joint section 43 provided as a joint sloping surface extending diagonally toward the outer circumference from the ring bottom surface 40 of the tolerance ring 33; an inner tapered surface 45, which is one step higher than the joint section 43 and extends diagonally further toward the outer circumference; and an outer tapered surface 46, which extends, from the inner tapered surface 45, diagonally further toward the outer circumference at a moderate angle. The inner tapered surface 45 and the outer tapered surface 46 constitute an abutting section 44, which faces the tapered surface 24 of the fuel injection valve 11. In other words, the joint section 43 is located in the inner circumference with respect to the abutting section 44, and most of the joint section 43 does not face the tapered surface 24 of the fuel injection valve 11.

Specifically, the inner circumferential edge of the joint section 43 continues into the inner circumferential edge of the ring bottom surface 40 via the inner circumferential surface of the tolerance ring 33. The plate inner end section 39 of the plate 32 is bent toward the outer circumference to abut the joint section 43. In other words, a force that acts toward the outer circumference and downward (the vibration damping member 31) is imparted by the plate inner end section 39 to the joint section 43. Therefore, the connection of the tolerance ring 33 to the vibration damping member 31 is reinforced, and the relative positional relationship thereof with the vibration damping member 31 is maintained unchanged.

A ridgeline 47 serving as a boundary between the inner tapered surface 45 and the outer tapered surface 46 is shown in FIG. 2 as a corner (an apex) of a protrusion sticking out toward the inner circumference from the abutting section 44. That is, the ridgeline 47 is a part at which the outer circumferential edge of the inner tapered surface 45 abuts the inner circumferential edge of the outer tapered surface 46, and the inner tapered surface 45 and the outer tapered surface 46 form a second tapered surface having two steps. In FIG. 2, the angle $\beta 1$ of the inner tapered surface 45 and the angle $\alpha$ of the tapered surface 24 of the fuel injection valve 11 are indicated as the respective angles of inclination of the inner tapered surface 45 and the outer tapered surface 46 to the axis parallel C1 of the tolerance ring 33. The angle $\beta 1$ of the inner tapered surface 45 is set smaller than the angle $\alpha$ of the tapered surface 24 of the fuel injection valve 11. The angle $\beta 2$ of the outer tapered surface 46 is set larger than the angle $\alpha$ of the tapered surface 24 of the fuel injection valve 11 ($\beta 1<\alpha<\beta 2$).

That is, the angle (tapering angle) $\beta 1$ of the inner tapered surface 45 and the angle (tapering angle) $\beta 2$ of the outer tapered surface 46 are set to angles different from the angle (tapering angle) $\alpha$ of the tapered surface 24 of the fuel injection valve 11, respectively. Furthermore, the angle $\alpha$ is set to a size between the angle $\beta 1$ and the angle $\beta 2$. In FIG. 2, the ridgeline 47 located between the inner tapered surface 45 and the outer tapered surface 46 appears as an apex that makes point contact with the tapered surface 24 of the fuel injection valve 11. In other words, the ridgeline 47 actually makes line-contact with the tapered surface 24 of the fuel injection valve 11.

FIG. 3(*b*) shows the axis Ca of the fuel injection valve 11 when the axis Ca is off-center with respect to the cylinder head 12. That is, as shown in FIG. 3(*b*), even when the fuel injection valve 11 inclines, a change in the height Hi from the shoulder section 18 of insertion hole 15 to the ridgeline 47 is unlikely to occur. As a result, the height at which the fuel injection valve 11 is supported with respect to the shoulder section 18 is maintained at the predefined height Hi. Furthermore, the vibration insulator 30 is capable of moving laterally in a manner following the deviation of the axis C of the fuel injection valve 11 from the centered position, whereby, even with the axis C of the fuel injection valve 11 being off-center, as in the case of the axis Ca, the distance of a line segment extended from the ridgeline 47 to the axis Ca in the radial direction is kept equal to the distance Ri of a line segment extended from the ridgeline 47 to the axis C in the radial direction when the axis C is centered as in the case of FIG. 3(*a*). In other words, the distance from the centerline of the fuel injection valve 11 to the ridgeline 47 is maintained at a predetermined distance, that is, the distance Ri.

Furthermore, when the axis C is deviated from the centered position under the influence of thermal expansion or the like, the vibration insulator 30 receives a laterally acting force from the fuel injection valve 11 due to a change in fuel pressure. The vibration insulator 30 is configured to absorb and damp vibration of the fuel injection valve 11 to a certain degree, but not to have the shape thereof flexed to a large degree, at the moment when the vibration insulator 30 receives the laterally acting force. In other words, the laterally acting force is hardly absorbed by the vibration insulator 30 and is efficiently used as a force that laterally moves the vibration insulator 30 on the shoulder section 18. That is, when the axis C is deviated from the centered position, the vibration insulator 30 quickly reacts to a laterally acting force received thereby from the fuel injection valve 11, and makes a movement in the inlet section 17 with a high level of responsiveness.

As described above, the vibration insulator of this embodiment brings about advantages as listed below.

(1) The angle $\beta 1$ of the inner tapered surface 45 and the angle $\beta 2$ of the outer tapered surface 46 of the tolerance ring 33 are set to angles different from the angle (tapering angle) $\alpha$ of the tapered surface 24 of the fuel injection valve 11. As a result, the tapered surface 24 of the fuel injection valve 11 makes line-contact with the tolerance ring 33. That is, even if a force that deviates the axis C of the fuel injection valve 11 from the centered position with respect to the insertion hole 15 of the cylinder head 12 is applied to the fuel injection valve 11, the tolerance ring 33, which supports the fuel injection valve 11 through line-contact, remains supporting the fuel injection valve 11 through line-contact by tracing the tapered surface 24 of the fuel injection valve 11. In other words, the deviation (slope) of the fuel injection valve 11 from the centered position is compensated for. Unlike the case where the fuel injection valve 11 is supported in surface contact, for example, the fuel injection valve 11 of this embodiment is allowed to become relatively freely inclined in the surrounding space of the ridgeline 47 while being supported through line-contact by the ridgeline 47. Therefore, concerns are eliminated that a force that does not permit deviation of the fuel injection valve 11 from the centered position or a reactive force may be produced at various points in the fuel injection valve 11.

As previously described, the distal end portion of the fuel injection valve is inserted into the insertion hole 15 of the cylinder head 12, and the proximal end portion is supported by the delivery pipe 13 via a sealing member such as the O-ring 29, whereby the fuel injection valve 11 is provided across the cylinder head 12 and the delivery pipe 13. However, even if a force that deviates the axis C of the fuel injection valve 11 from the centered position is produced from the fuel injection valve 11 due to application of fuel pressure associated with the operation of the internal combustion engine, the tolerance ring 33, which supports the fuel injection valve 11 through line-contact, compensates for the deviation. Therefore, the sealing performance at the proximal end portion of the injection valve supported by the delivery pipe 13 via the O-ring 29 is also maintained well.

(2) In other words, when the axis C of the fuel injection valve 11 is deviated from the centered position, the tapered surface 24 of the fuel injection valve 11 slides with respect to the ridgeline 47 of the tolerance ring 33. Therefore, the tolerance ring 33 is automatically allowed to keep supporting the fuel injection valve 11 through line-contact, thus automatically compensating for deviation of the axis C from the centered position.

(3) When the difference (β2−β1) in angles of the two-stepped tapered surfaces, that is, the inner tapered surface 45 and the outer tapered surface 46, is reduced, the angle at the ridgeline 47 is increased and becomes an obtuse angle. As a result, even if the tapered surface 24 of the fuel injection valve 11 is pressed against the ridgeline 47 with a strong force, the ridgeline 47 can appropriately receive the pressing force. Therefore, the reliability and stability of the vibration insulator 30 is improved.

(4) The tolerance ring 33 is formed of metal having the same level of hardness as the tapered surface 24 of the fuel injection valve 11. Thus, even if the fuel injection valve 11 and the tolerance ring 33 are strongly pressed against each other, one of the fuel injection valve and the tolerance ring that abut each other does not deform the other, but they evenly oppose each other. Therefore, the reliability and stability of the vibration insulator 30 is improved.

(5) The vibration damping member 31 is provided with the sleeve 35. With this, when a large pressing force is received from the fuel injection valve 11, an excessive deformation of the elastic member 36 is restricted, which may lead to such a large deformation that the elastic member is plastically deformed. This allows the elastic member 36 to be used within a range (height) that permits elastic deformation, the elasticity of the elastic member 36 is appropriately maintained, and with the elasticity, vibration absorbing and damping functions can be maintained.

(6) Since the coil spring 34 and the sleeve 35 are separated away from each other, the interference of the sleeve 35 with the coil spring 34 is reduced. That is, the possibility of change of the vibration damping performance imparted to the coil spring 34 due to interference with the sleeve 35 is reduced. Therefore, the vibration damping performance of the vibration insulator 30 can be appropriately maintained.

(7) The sleeve 35 is embedded toward the outer circumference of the coil spring 34. Therefore, the coil spring 34 can be downsized. In addition, since the sleeve 35 is located on the outside of the coil spring 34, the sleeve 35 is not formed into a size that allows the sleeve to fall in the insertion hole 15 of the cylinder head 12.

(8) The elastic member 36 is formed of rubber material, and the coil spring 34 and the sleeve 35 are formed of metal materials. Therefore, characteristics suitable for absorbing and damping vibration of the fuel injection valve 11 can be imparted.

(9) The plate 32 is configured to pinch the tolerance ring 33 and the elastic member 36 together from the inner circumferential side. That is, the plate 32 is formed so as to press the tolerance ring 33 toward the elastic member 36. Thus, the relative position of the tolerance ring 33, which cannot be easily joined strongly to the elastic member 36, with respect to the elastic member 36 is defined by the plate 32 from the inner circumferential surface of the tolerance ring 33. Therefore, appropriate stacking of the tolerance ring 33 on the elastic member 36 is facilitated, whereby improvement of the feasibility of the vibration insulator 30 as described herein is enabled.

(10) It is preferable that the size of the shoulder section 18 formed on the insertion hole 15 of the cylinder head 12 be formed into the requisite minimum size that enables deviation of the axis C of the fuel injection valve 11 from the centered position to be compensated for by movement of the vibration insulator 30 on the shoulder section 18. For that end, the plate 32 is provided with the burr section 37R. That is, while the vibration insulator 30 is prevented from overriding a portion that remains unshaved as a bulge at the outer circumferential part of the shoulder section 18 formed on the insertion hole 15 of the cylinder head 12 in a widening manner, the size of the shoulder section 18 formed on the insertion hole 15 can be set at the requisite minimum size. Therefore, even if the vibration insulator 30 moves toward the outside of the shoulder section 18, the moving performance of the vibration insulator 30 on the shoulder section 18 is not reduced, change of the height of the tapered surface 24 of the fuel injection valve 11 from the shoulder section 18 by overriding a bulge is prevented, and the height accuracy and the vibration damping compensation accuracy of the vibration insulator 30 are maintained.

(11) For the plate 32, a material suitable for press working can be selected for appropriate processing. Thus, the feasibility of the vibration insulator 30 of the above structure is improved. In addition, suitable members can be selected that enable the plate 32 to slide on the shoulder section 18 and the elastic member 36 to widely disperse and transmit the pressure received from the tolerance ring 33 to the shoulder section 18. As a result, the durability and performance of the vibration insulator 30 can be maintained and improved, further increasing the reliability.

Second Embodiment

Figure 4:
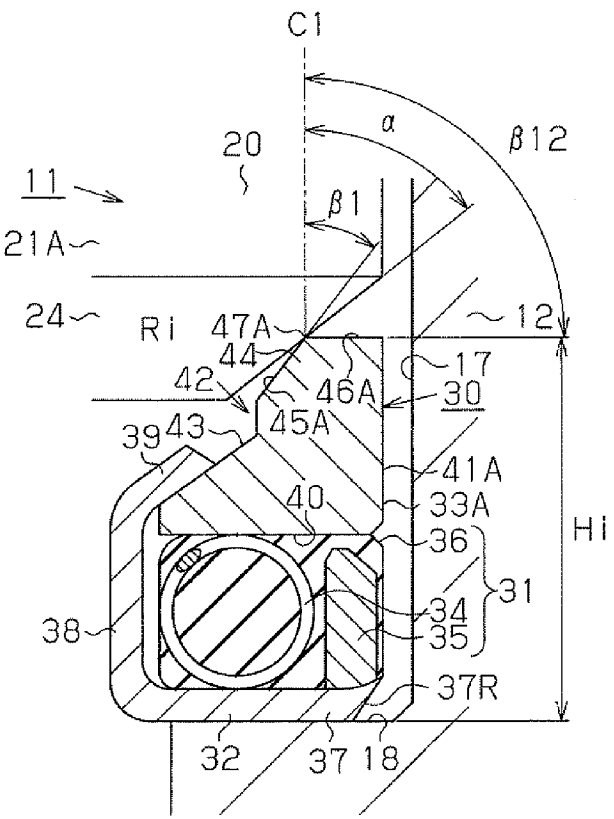
FIG. 4 is an end view showing the structure of an end face of the vibration insulator according to a second embodiment of the present invention.

FIG. 4 is an end view showing the structure of a vibration insulator 30 according to a second embodiment of the present invention. Since this embodiment differs from the first embodiment in structure of the tolerance ring of the vibration insulator 30 but the other structures are the same, differences from the first embodiment are mainly described, and description of members similar to those of the first embodiment is omitted by assigning the same reference signs thereto, for illustrative purposes.

As shown in FIG. 4, the vibration insulator 30 is formed by sequentially stacking a vibration damping member 31 and a tolerance ring 33A on a plate bottom section 37 of a plate 32.

The tolerance ring 33A, as in the case of the first embodiment, supports the fuel injection valve 11 by abutting the tapered surface 24 of the fuel injection valve 11 and is formed of metal such as stainless steel. Also, the tolerance ring 33A, as in the case of the first embodiment, includes the ring bottom surface 40 connected to the vibration damping member 31, the outer circumferential surface 41A of the ring, the horizontal upper surface 46A of the ring extending from the upper end of the outer circumferential surface 41A of the ring toward the center of the ring, and the inner circumferential sloping surface 42 forming a recessed taper from the inner circumferential edge of the upper surface 46A of the ring toward the center of the ring. The inner circumferential sloping surface 42 has the joint section 43 and the tapered surface 45A. The tapered surface 45A forms the abutting section 44 of the tolerance ring 33A. That is, the tapered surface 45A in FIG. 4 is one-stepped second tapered surface of the tolerance ring 33A.

The outer circumferential surface 41A of the ring is formed to have substantially the same outer diameter as the outer diameter of the vibration damping member 31, the outer circumferential surface 41A of the ring is formed to have a predetermined height Hi for supporting the fuel injection valve 11. The height Hi is defined as the distance from the shoulder section 18. That is, the height from the shoulder section 18 of the ring upper surface 46A horizontally extending from the upper end of the ring outer circumferential surface 41A is also set as the height Hi.

The inner circumferential sloping surface 42 is provided between the inner circumferential edge of the ring bottom surface 40 and the inner circumferential edge of the ring upper surface 46A. The joint section 43 is located at the inside of the inner circumferential sloping surface 42 and abuts the plate inner end 39 of the plate 32. The tapered surface 45A is located at the outside of the inner circumferential sloping surface 42 and faces the tapered surface 24 of the fuel injection valve 11.

A ridgeline 47A (an apex in the cross sectional view) is formed at the joint portion between the outer circumferential edge of the tapered surface 45A and the inner circumferential edge of the ring upper surface 46A. The angle $\beta 1$ of the tapered surface 45A is set smaller than the angle $\alpha$ of the tapered surface 24 of the fuel injection valve 11. The angle $\beta 12$ of the ring upper surface 46A to the axis parallel C1 is set larger than the angle $\alpha$ of the tapered surface 24 and at a substantially right angle. As a result, the angle (tapering angle) $\beta 1$ of the tapered surface 45A and the angle (tapering angle) $\beta 2$ of the ring upper surface 46A are set to angles different from the angle (tapering angle) $\alpha$ of the tapered surface 24 of the fuel injection valve 11, and the angle $\alpha$ is an angle between the angles $\beta 1$ and $\beta 12$ on ($\beta 1<\alpha<\beta 12$). Therefore, the ridgeline 47A serving as a boundary between the tapered surface 45A and the ring upper surface 46A appears, in FIG. 4, as an apes that makes point contact with the tapered surface 24 of the fuel injection valve 11. Actually, the ridgeline 47 makes line-contact with the tapered surface 24 of the fuel injection valve 11.

By the line-contact shown in FIG. 4, a change in the height Hi from the shoulder section 18 of the insertion hole 15 to the ridgeline 47A is unlikely to occur even if the axis C of the fuel injection valve 11 is deviated from the centered position, whereby a supported height of the fuel injection valve 11 is maintained at the predetermined height Hi. Furthermore, the vibration insulator 30 follows (traces) the deviation of the axis C of the fuel injection valve 11, whereby, even with the axis C of the fuel injection valve 11 deviated from the centered position, the length of a line segment extended from the ridgeline 47A to the axis Ca in the radial direction is maintained at the predetermined length Ri. In addition, when the axis C is deviated from the centered position, the vibration insulator 30 quickly reacts to a laterally acting force received thereby and makes a movement in the inlet section 17 with a high level of responsiveness.

As described above, this embodiment of FIG. 4 not only brings about advantages that are the same as or similar to the above advantages (1) and (11) of the first embodiment described above, but also brings about advantages as listed below.

(12) The tolerance ring 33A in FIG. 4 has a one-stepped tapered surface 45A on the inner circumference. However, the ridgeline 47A, which is the upper circumferential edge of the tapered surface 45A, abuts the tapered surface 24 of the fuel injection valve 11, whereby the line-contact support can be maintained and the deviation of the fuel injection valve 11 can be compensated for. In addition, since the tapered surface of the inner circumference of the tolerance ring 33A has one step, the feasibility is improved.

Third Embodiment

Figure 5:
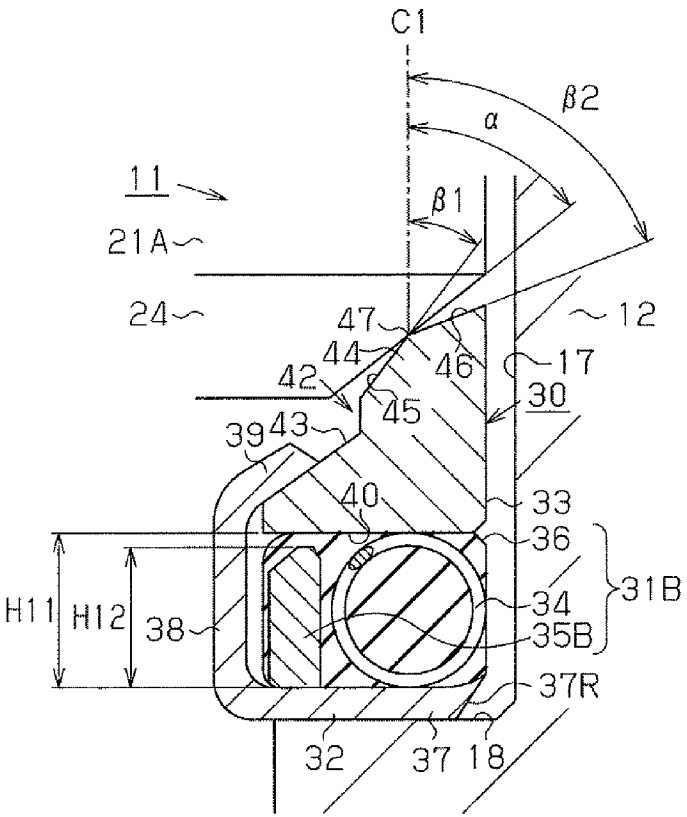
FIG. 5 is an end view showing the structure of an end face of the vibration insulator according to a third embodiment of the present invention.

FIG. 5 is an end view showing the structure of a vibration insulator 30 according to a third embodiment of the present invention. Since this embodiment differs from the first embodiment in structure of the vibration damping member of the vibration insulator 30 but the other structures are the same, differences from the first embodiment are mainly described, and description of members similar to those of the first embodiment is omitted by assigning the same reference signs thereto, for illustrative purposes.

As shown in FIG. 5, the vibration insulator 30 is formed by sequentially stacking the vibration damping member 31B and the tolerance ring 33 on the plate bottom section 37 of the plate 32. The vibration damping member 31B is a member for absorbing and damping vibration of the fuel injection valve 11 and includes an elastic member 36 such as rubber, a coil spring 34 annularly embedded in the elastic member 36 and a sleeve 35B located from the coil spring 34 toward the inner circumference and also annularly embedded in the elastic member 36.

The sleeve 35B is made of metal having a higher stiffness than that of the coil spring 34 and has an annular shape. The outer diameter of the sleeve 35B is sized not to contact the inner circumference of the coil spring 34 located outside of the sleeve. The sleeve 35B is formed to have the height H12 smaller than the outer diameter H11 of the small ring section of the coil spring 34 in cross section.

Thus, as in the case of the vibration damping member 31 of the first embodiment, characteristics suitable for absorption and damping of vibration that occurs to the fuel injection valve 11 are imparted to the vibration damping member 31B based on vibration absorbing and vibration damping characteristics of the elastic member 36 and vibration absorbing and vibration damping characteristics of the coil spring 34. Without the sleeve 35B, the elastic member 36 and the coil spring 34, as in the case of the first embodiment, show appropriate vibration absorbing and vibration damping characteristics with appropriate elastic deformation when a load within a predetermined range that permits the maintenance of the elasticity thereof is applied thereto. However, application of a load exceeding the predetermined range may cause plastic deformation and loss of the elasticity, failing to show appropriate vibration absorbing and vibration damping characteristics. In this embodiment, however, the sleeve 35B prevents deformation of the elastic member 36 and the coil spring 34 even if a load exceeding the predetermined range is applied thereto.

That is, when the elastic member 36 and the coil spring 34 experience deformation in forms vertically crushed by a pressing force from the fuel injection valve 11, they deform freely as long as the amount of deformation thereof is a predetermined amount of deformation or smaller, and the sleeve 35B prevents deformation exceeding a predetermined amount of deformation. Therefore, even if a high pressure is suddenly applied to the vibration damping member 31B, the sleeve 35B prevents plastic deformation of the elastic member 36 and the coil spring 34 and the elasticity of the elastic member 36 and the coil spring 34 is maintained. The sleeve 35B is configured not to contact the coil spring 34. This reduces the possibility that abutting of the coil spring 34 against the sleeve 35B causes change in the vibration absorbing and vibration damping characteristics of the coil spring 34, and the vibration damping member 31B can show suitable vibration absorbing and vibration damping characteristics on which the sleeve 35B has little effect.

As described above, the embodiment of FIG. 5 not only brings about advantages that are the same as or similar to the above advantages (1) and (11) of the first embodiment described above, but also brings about advantages as listed below.

(13) The sleeve 35B is embedded in the inner circumference of the coil spring 34. Thus, the coil spring 34 is enlarged, and the pressure resistance to the pressing force is increased.

Fourth Embodiment

Figure 6:
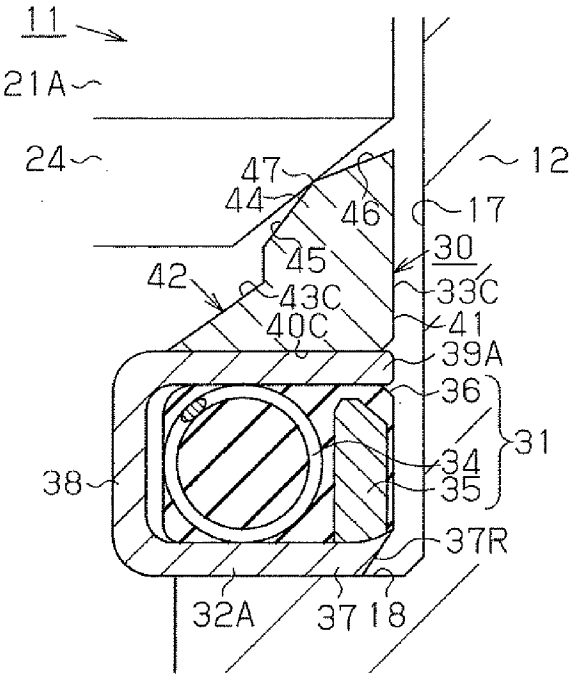
FIG. 6 is an end view showing the structure of an end face of the vibration insulator according to a fourth embodiment of the present invention.

FIG. 6 is a diagram showing the structure of an end face of the vibration insulator 30 according to a fourth embodiment of the present invention in an end view. Since this embodiment differs from the first embodiment in structure of the plate of the vibration insulator 30 but the other structures are the same, differences from the first embodiment are mainly described, and description of members similar to those of the first embodiment is omitted by assigning the same reference signs thereto, for illustrative purposes.

As shown in FIG. 6, the vibration insulator 30 is formed by sandwiching the vibration damping member 31 by the plate 32A and stacking the tolerance ring 33C on the vibration damping member 31 and on the plate 32. The plate 32A is formed of metal such as stainless steel as in the case of the plate 32 of the first embodiment. The plate 32A in FIG. 6, however, includes a plate bottom section 37, a plate inner wall section 38 extending upwardly from the inner circumference of the plate bottom section 37 along the vibration damping member 31 and a plate upper part 39A extending from the upper end of the plate inner wall section 38 to the outer circumferential edge of the vibration damping member 31 along the upper surface of the vibration damping member 31.

The plate upper part 39A is stacked on the upper surface of the vibration damping member 31. Therefore, the plate 32A sandwiches the vibration damping member 31 from the top and bottom surfaces, whereby the vibration damping member 31 is suitably protected. Furthermore, the connectivity of the plate 32A and the tolerance ring 33C, which is formed of metal, is increased.

The tolerance ring 33C is, as in the case of the tolerance ring 33 of the first embodiment, formed of metal such as stainless steel, for example, SUS304, which is a hard stainless steel material, and includes the ring bottom surface 40C connected to the plate 32A, the ring outer circumferential surface 41, and the tapered inner circumferential sloping surface 42 extending from the upper section of the ring outer circumferential surface 41 toward the center of the ring.

As shown in FIG. 6, the ring bottom surface 40C is stacked on the upper surface of the vibration damping member 31 via the plate upper part 39A of the plate 32. The ring bottom surface 40C transmits a pressing force that the tolerance ring 33C receives from the fuel injection valve 11 to the upper surface of the vibration damping member 31 through the entirety of the ring bottom surface 40C and further via the plate upper part 39A. Therefore, since the pressing force is evenly applied to the vibration damping member 31, inconveniences are prevented from occurring that include an incident where a locally concentrated force causes the vibration damping member 31 to plastically deform. In addition, the firm connection between the ring bottom surface 40C and the plate upper part 39A allows the relative positional relationship of the tolerance ring 33C and the vibration damping member 31 to keep unchanged.

The inner circumference section of the inner circumferential sloping surface 42 forms the joint section 43C, which hardly faces the tapered surface 24 of the fuel injection valve 11, and the outer circumferential section of the inner circumferential sloping surface 42 forms the abutting section 44, which faces the tapered surface 24 of the fuel injection valve 11. The abutting section 44 includes the inner tapered surface 45, the outer tapered surface 46 and the ridgeline 47. The inner circumferential edge of the joint section 43C directly continues with the inner circumferential edge of the ring bottom surface 40C.

As described above, the embodiment in FIG. 6 not only brings about the advantages that are the same as or similar to the above advantages (1) to (11) of the first embodiment, but also brings about the advantages as listed below.

(14) The top and bottom surfaces of the vibration damping member 31 are wholly sandwiched by the plate 32A. Therefore, protection of the vibration damping member 31 is conducted more appropriately.

(15) The tolerance ring 33C is connected to the plate upper part 39A of the plate 32A, which sandwiches the elastic member 36. Accordingly, the relative position of the tolerance ring 33C, which is not easy to be strongly joined to the elastic member 36, with respect to the elastic member 36 is surely defined. This facilitates appropriate stacking of the tolerance ring 33C onto the elastic member 36, resulting in improvement in feasibility of the above vibration insulator 30.

Fifth Embodiment

Figure 7:
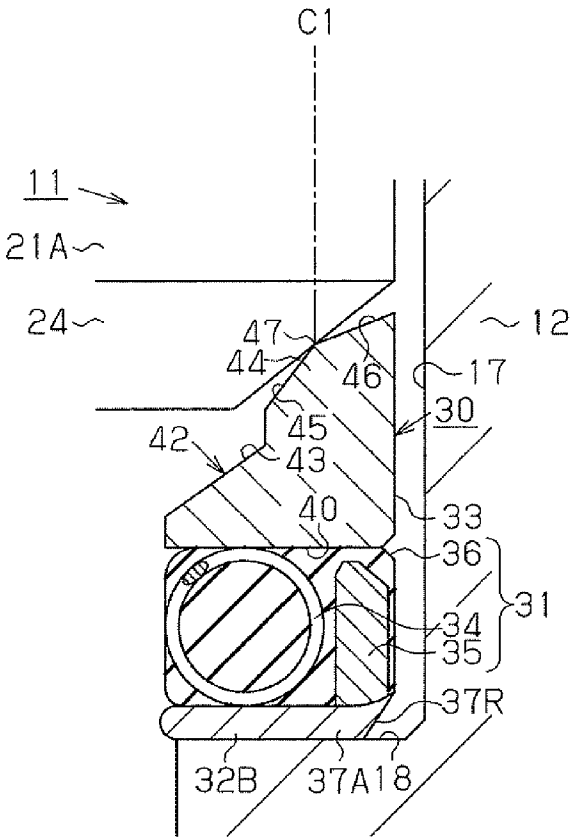
FIG. 7 is an end view showing the structure of an end face of the vibration insulator according to a fifth embodiment of the present invention.

FIG. 7 is a diagram showing the structure of an end face of the vibration insulator 30 according to a fifth embodiment of the present invention in an end view. Since this embodiment differs from the first embodiment in structure of the plate of the vibration insulator 30 but the other structures are the same, differences from the first embodiment are mainly described, and description of members similar to those of the first embodiment is omitted by assigning the same reference signs thereto, for illustrative purposes.

As shown in FIG. 7, the plate 32B of the vibration insulator 30 consists of only the plate bottom section 37A. That is, the plate inner wall section 38 and the plate inner end 39 are deleted. On the plate 32B, the vibration damping member 31 and the tolerance ring 33 are sequentially stacked.

The plate bottom section 37A is, as in the case of the plate 32 of the first embodiment, formed of metal such as stainless steel, for example, SUS430, which is a stainless steel material to which a drawing process is easily applicable.

As in the case of the plate bottom section 37 of the first embodiment, the vibration damping member 31 is connected to the upper surface of the plate bottom section 37A, and the lower surface of the plate bottom section 37A abuts the shoulder section 18 of the insertion hole 15. This allows the plate 32B to suitably slide with relation to the shoulder section 18 of the insertion hole 15. Furthermore, a force that the plate 32B received from the coil spring 34 and the sleeve 35 is evenly distributed to the shoulder section 18. Since the shoulder section 18 is formed on the cylinder head 12 formed of aluminum or the like, the hardness of the shoulder section 18 is lower than that of the coil spring 34 or the sleeve 35. Therefore, when the coil spring 34 or the sleeve 35 comes in direct contact with the shoulder section 18, an inconvenience of having a part of the shoulder section 18, on which a force is concentrated, shaved or deformed may occur. In this embodiment, a force received by the plate 32B from the coil spring 34 or the sleeve 35 is dispersed and transmitted to the shoulder section 18 via the plate bottom section 37A. This prevents occurrence of the inconvenience that might occur when the coil spring 34 or the sleeve 35 comes in direct contact with the shoulder section 18.

As described above, the embodiment in FIG. 7 not only brings about advantages that are the same as or similar to the above advantages (1) to (11) of the first embodiment described above, but also brings about advantages as listed below.

(16) The structure of the plate 32B is simplified. Therefore, the vibration insulator 30 can be downsized.

Sixth Embodiment

Figure 8:
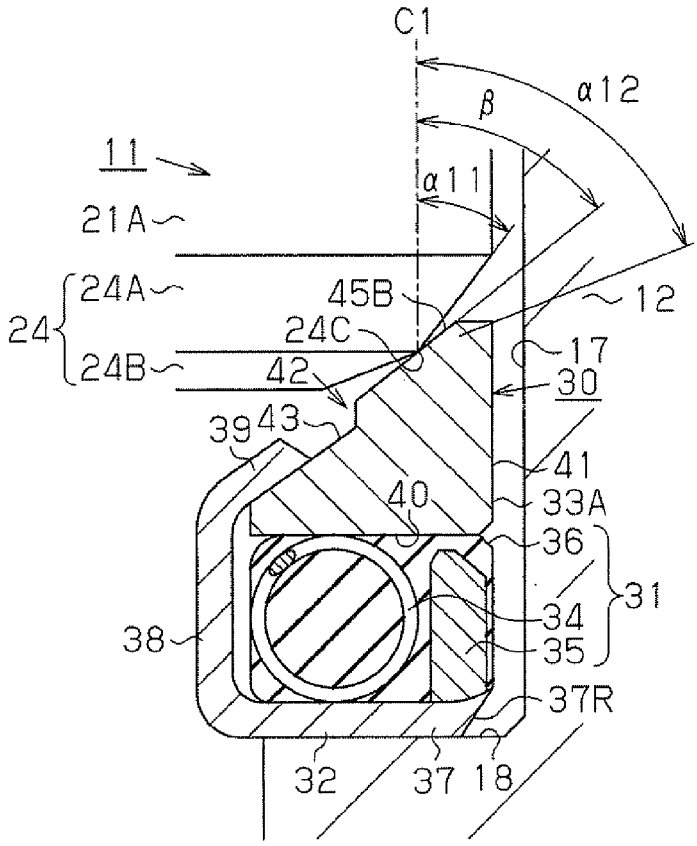
FIG. 8 is an end view showing the structure of an end face of the vibration insulator according to a sixth embodiment of the present invention.

FIG. 8 is a diagram showing the support structure of an end face of the vibration insulator according to a sixth embodiment of the present invention in an end view. That is, FIG. 6 shows the support structure of the fuel injection valve 11 of the vibration insulator 30. Since this embodiment differs from the first embodiment in structure of the tapered surface of the fuel injection valve 11 and the tolerance ring of the vibration insulator 30 but the other structures are the same, differences from the first embodiment are mainly described, and description of members similar to those of the first embodiment is omitted by assigning the same reference signs thereto, for illustrative purposes.

As in the case of the first embodiment, the fuel injection valve 11 in FIG. 8 has a housing of a cylindrical shape, stepped with multiple steps, which narrows sequentially in directions from the large diameter section 20 in the center toward the distal end and the proximal end.

Between the large diameter section 20 and the medium diameter section 21 of the fuel injection valve 11, a stepped section based on the difference between the outer diameter of the large diameter section 20 and the outer diameter of the medium diameter section 21 is formed, and this stepped section is provided with a tapered surface 24 having a shape narrowed in a direction toward the distal end.

The tapered surface 24 of this embodiment has two steps and has the outer tapered surface 24A and the inner tapered surface 24B having the outer circumferential edge contacting the inner circumferential edge of the outer tapered surface 24A. The connecting part of the inner circumferential edge of the outer tapered surface 24A and the outer circumferential edge of the inner tapered surface 24B is the ridgeline 24C as a border. The outer tapered surface 24A and the inner tapered surface 24B form a two-stepped first tapered surface and face the shoulder section 18 of the cylinder head 12 with a predetermined inclination thereto when the fuel injection valve 11 is inserted in the insertion hole 15.

Specifically, the angle $\alpha$12 of the inner tapered surface 24B is set larger than the angle $\alpha$11 of the outer tapered surface 24A. That is, the angle (tapering angle) all of the outer tapered surface 24A is different from the angle (tapering angle) $\alpha$12 of the inner tapered surface 24B. Therefore, in FIG. 8, the ridgeline 24C is an apex, and actually, the loop-like ridgeline 24C is formed on the tapered surface 24.

As shown in FIG. 8, in the vibration insulator 30, the vibration damping member 31 is stacked on the plate bottom section 37 of the plate 32, and the tolerance ring 33A is further stacked on the vibration damping member 31 as in the case of FIG. 3.

The tolerance ring 33A abuts the tapered surface 24 of the fuel injection valve 11 and supports the fuel injection valve 11. The tolerance ring 33A is formed of metal such as stainless steel as in the case of the tolerance ring 33 of the embodiment in FIG. 3 and includes the ring bottom surface 40 connected to the vibration damping member 31, the ring outer circumferential surface 4,1 and the inner circumferential sloping surface 42 forming a recessed taper from the upper surface of the ring outer circumferential surface 41 toward the center of the ring.

On the inside of the inner circumferential sloping surface 42, the joint section 43 that hardly faces the tapered surface 24 of the fuel injection valve 11 is formed, and on the outside of the inner circumferential sloping surface 42, the tapered surface 45B that faces the tapered surface 24 of the fuel injection valve 11 is formed. The joint section 43 is pressed toward the vibration damping member 31 by the plate inner end 39.

The angle $\beta$ of the tapered surface 45B is set larger than the angle $\alpha$11 of the outer tapered surface 24A of the fuel injection valve $\alpha$11 and smaller than the angle $\alpha$12 of the inner tapered surface 24B of the fuel injection valve 11 ($\alpha 11<\beta<\alpha 12$). Therefore, the angle (tapering angle) $\beta$ of the tapered surface 45B is different from both the angle (tapering angle) $\alpha$11 of the outer tapered surface 24A of the fuel injection valve 11 and the angle (tapering angle) $\alpha$12 of the inner tapered surface 24B. As a result, the ridgeline 23C of the fuel injection valve 11 appears to make point contact with the tapered surface 45B of the tolerance ring 33A in FIG. 8, but is actually supported through line-contact with it. Specifically, although it is preferable for the angle $\beta$ of the tapered surface 45B of the tolerance ring 33A to be 30 to 60 degrees, the angle $\beta$ is selectable from values larger than 0 degrees and smaller than 90 degrees.

As described above, this embodiment not only brings about advantages that are the same as or similar to the above advantages (1) and (11) of the first embodiment described above, but also brings about advantages as listed below.

(17) The tapered surface 45B of the inner circumference of the tolerance ring 33A abuts the ridgeline 24C of the tapered surface 24 of the fuel injection valve 11. When the axis C of the fuel injection valve 11 is deviated from the centered position, the ridgeline 24C slides on the tapered surface 45B of the tolerance ring 33A, whereby the deviation of the axis C is automatically compensated for. In addition, when the difference in angle ($\alpha 12-\alpha 11$) between two-stepped tapered surfaces of the fuel injection valve 11, that is, the outer tapered surface 24A and the inner tapered surface 24B is reduced, the fuel injection valve 11 can suitably receive the pressing force even if the ridgeline 24C is pressed to the tapered surface 45B of the tolerance ring 33A by a strong force. Therefore, the reliability and stability of the support structure of the fuel injection valve 11 are improved.

Each of the above embodiments may be modified, for example, in the following modes.

Figure 9:
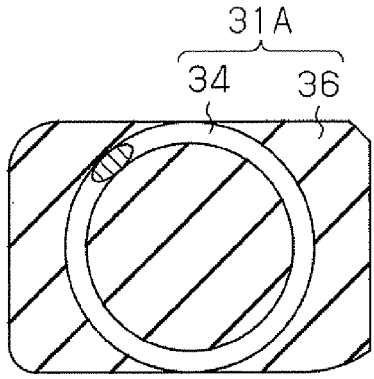
FIG. 9 is an end view showing the structure of an end face of the vibration insulator according to another embodiment of the present invention.

Each embodiment described above shows, as an example, a case where the sleeve 35 or 35B is used for the vibration damping member 31. However, the present invention is not limited to such a case, and the sleeve does not need to be used for the vibration damping member. That is, as shown in FIG. 9, the sleeve may be deleted and the vibration damping member 31A having only the coil spring 34 embedded in the elastic member 36 may be used.

Each of the first, second and fourth to sixth embodiments described above shows, as an example, a case where the sleeve 35 of the vibration damping member 31 is provided toward the outside from the coil spring 34, and the third embodiment of FIG. 5 shows, as an example, a case where the sleeve 35B is provided toward the inside from the coil spring 34. However, the location of the sleeve of the vibration damping member is not limited to such a case. Also, the sleeve of the vibration damping member may be provided toward the inside or the outside of the coil spring in any of the embodiments.

Each of the above embodiments shows, as an example, a case where the vibration insulator 30 is provided with the vibration damping member 31 having the elastic member 36, the coil spring 34 and the sleeve 35. However, the present invention is not limited to such a case, and is not limited to a vibration damping member of the exemplified structure. Any vibration damping member having a vibration absorbing and damping function may be used by the application of any vibration damping members formed of elastic materials of various kinds, springs of various kinds or combinations thereof.

Each of the above described embodiments shows, as an example, a case where the coil spring 34 and the sleeve section 35 (or any one of 35A to 35D) are spaced apart from each other. However, the present invention is not limited to such a case, and the coil spring may be configured to stay in contact with or to come in contact with the sleeve section.

Each of the above embodiments shows, as an example, a case where the inlet section 17 is formed into the requisite minimum size that enables the vibration insulator 30 to move to compensate for deviation of the axis. However, the present invention is not limited to such a case, but the inlet section may be formed into a size larger than the requisite minimum size that enables the vibration insulator to move to compensate for deviation of the axis.

An internal combustion engine to which this invention is applied may be either a gasoline engine or a diesel engine as long as the engine is an internal combustion engine of the in-cylinder injection system.

DESCRIPTION OF THE REFERENCE NUMERALS

10 . . . fuel injection system
11 . . . fuel injection valve
12 . . . cylinder head
13 . . . delivery pipe
14 . . . fuel injection valve cup
14A . . . inner circumferential surface
15 . . . insertion hole
16 . . . distal end hole section
17 . . . inlet section
18 . . . shoulder section
20 . . . large diameter section
21 . . . medium diameter section
21R . . . ring
22 . . . small diameter section
23 . . . injection nozzle
24 . . . tapered surface as the first tapered surface
24A . . . outer tapered surface, which is a part of the two-stepped first tapered surface
24B . . . inner tapered surface, which is a part of the two-stepped first tapered surface
24C . . . ridgeline
25 . . . sealed section
26 . . . proximal relay section
26J . . . connector
27 . . . proximal insertion section
28 . . . sealed section
29 . . . O-ring
30 . . . vibration insulator
31 . . . vibration damping member
31A, 31B . . . vibration damping member
32, 32A, 32B . . . plate
33, 33A, 33C . . . tolerance ring
34 . . . coil spring
35, 35B . . . sleeve
36 . . . elastic member
37, 37A . . . plate bottom section
37R . . . burr section
38 . . . plate inner wall section
39 . . . plate inner end
39A . . . plate upper part
40, 40C . . . bottom surface
41, 41A . . . outer circumferential surface,
42 . . . inner circumference
43, 43C . . . joint section
44 . . . abutting section
45, 45A, 45B . . . inner tapered surface which is a part of one-stepped second tapered surface or two-stepped second tapered surface
46 . . . outer tapered surface which is a part of two-stepped second tapered surface
46A . . . upper surface
47, 47A . . . ridgeline

The invention claimed is:

1. A vibration insulator for a fuel injection valve, the vibration insulator damping vibration that occurs to the fuel injection valve, wherein the fuel injection valve is mounted on a cylinder head while being inserted into an insertion hole provided in the cylinder head, a shoulder section is annularly formed at an inlet portion of the insertion hole in a widening manner, the fuel injection valve includes a stepped section, a diameter of which is enlarged in a tapered manner so that the stepped section has a first tapered surface facing the shoulder section, and the vibration insulator is configured to damp vibration in the fuel injection valve by locating the vibration insulator between the stepped section and the shoulder section, the vibration insulator includes a circular ring-like tolerance ring abutting the first tapered surface by having, on the inner circumference thereof, a recessed second tapered surface facing the first tapered surface, and a tapering angle of the second tapered surface is different from a tapering angle of the first tapered surface, a bottom of the vibration insulator has an outer circumference that contacts the shoulder section, and a position at which second tapered surface and first tapered surface abut each other is located radially inward of the outer circumference of the bottom of the vibration insulator.

2. The vibration insulator for a fuel injection valve according to claim 1, wherein the second tapered surface is formed into two steps such that a ridgeline exists as a border between the steps, and that the ridgeline abuts the first tapered surface, the ridgeline projecting toward an inner circumference of the tolerance ring.

3. The vibration insulator for a fuel injection valve according to claim 1, wherein the tapering angle of the first tapered surface and the tapering angle of the second tapered surface are set such that an upper circumferential edge of the second tapered surface abuts the first tapered surface.

4. The vibration insulator for a fuel injection valve according to claim 1, wherein the tolerance ring is formed of metal having the same level of hardness as a housing of the fuel injection valve.

5. The vibration insulator for a fuel injection valve according to claim 1, comprising an elastic member arranged between the tolerance ring and the shoulder section, wherein, in order to perform damping of vibration that occurs to the fuel injection valve, the elastic member is formed in a circular ring-like shape corresponding to the bottom surface of the tolerance ring, wherein a coil spring, which is arranged in a circular ring-like shape in a manner corresponding to the circular ring-like shape of the elastic member, and a sleeve, which is provided side by side with the coil spring, are embedded in the elastic member, and the height of the sleeve is lower than an outer diameter of each of small spring sections composing the helix of the coil spring, and the stiffness of the sleeve is higher than the stiffness of the coil spring.

6. The vibration insulator for a fuel injection valve according to claim 5, wherein the coil spring and the sleeve are embedded in the elastic member while being maintained in a state not contacting with each other.

7. The vibration insulator for a fuel injection valve according to claim 5, wherein the sleeve is located toward the outer circumference of the coil spring.

8. The vibration insulator for a fuel injection valve according to claim 5, wherein the sleeve is located toward the inner circumference of the coil spring.

9. The vibration insulator for a fuel injection valve according to claim 5, wherein the elastic member is formed of a rubber-based material, and the coil spring and the sleeve are formed of metal materials.

10. The vibration insulator for a fuel injection valve according to claim 5, further comprising a circular ring-like metal plate located between the elastic member and the shoulder section, wherein the metal plate is configured to pinch the tolerance ring and the elastic member together from the inner circumference of the tolerance ring.

11. The vibration insulator for a fuel injection valve according to claim 10, wherein the metal plate is formed by pressing such that a burr is generated at an outer circumferential edge of the metal plate, the burr having been cut upward toward the elastic member.

12. The vibration insulator for a fuel injection valve according to claim 10, wherein the metal plate is formed of a metal having a lower level of hardness than the tolerance ring.

13. A fuel injection valve supporting structure for support a fuel injection valve by using a vibration insulator, wherein the fuel injection valve is mounted on a cylinder head while being inserted into an insertion hole provided in the cylinder head, a shoulder section is annularly formed at an inlet portion of the insertion hole in a widening manner, the fuel injection valve includes a stepped section, a diameter of which is enlarged in a tapered manner so that the step section has a first tapered surface facing the shoulder section, and the vibration insulator is configured to damp vibration occurred to the fuel injection valve by interposing the vibration insulator between the stepped section and the shoulder section, the vibration insulator includes a circular ring-like tolerance ring abutting the first tapered surface by having, on the inner circumference thereof, a recessed second tapered surface facing the first tapered surface, and a tapering angle of the second tapered surface is different from a tapering angle of the first tapered surface, a bottom of the vibration insulator has an outer circumference that contacts the shoulder section, and a position at which second tapered surface and first tapered surface abut each other is located radially inward of the outer circumference of the bottom of the vibration insulator.

14. The fuel injection valve supporting structure according to claim 13, wherein the first tapered surface is formed into two steps such that a ridgeline exists as a border between the steps, and the ridgeline abuts the second tapered surface, the ridgeline projecting toward the outer circumference.

* * * * *